US010405675B1

(12) United States Patent
Yu

(10) Patent No.: US 10,405,675 B1
(45) Date of Patent: Sep. 10, 2019

(54) HANGING PANEL HANGER

(71) Applicant: Fengyu Yu, Shanghai (CN)

(72) Inventor: Fengyu Yu, Shanghai (CN)

( * ) Notice: Subject to any disclaimer, the term of this patent is extended or adjusted under 35 U.S.C. 154(b) by 0 days.

(21) Appl. No.: 16/014,859

(22) Filed: Jun. 21, 2018

(30) Foreign Application Priority Data

May 29, 2018 (CN) ..... 2018 2 0807434 U

(51) Int. Cl.
*A47F 5/00* (2006.01)
*A47F 5/08* (2006.01)
*G09F 19/22* (2006.01)

(52) U.S. Cl.
CPC ..... *A47F 5/0823* (2013.01); *G09F 19/22* (2013.01)

(58) Field of Classification Search
CPC ..... A47F 5/0823; A47F 5/0815
USPC .... 248/220.31, 220.41, 220.42, 220.43, 303, 248/304
See application file for complete search history.

(56) References Cited

U.S. PATENT DOCUMENTS 7,798,338 B2 * 9/2010 Maheu ..... A47F 5/0815 211/103
8,307,995 B2 * 11/2012 Surma ..... A47F 5/0861 211/59.1
9,486,913 B2 * 11/2016 Thieman ..... A47F 5/0823
2005/0218280 A1 * 10/2005 Rojas ..... A47F 5/0815 248/220.31
2006/0278782 A1 * 12/2006 Lockwood ..... A47F 5/0823 248/220.31
2012/0018601 A1 * 1/2012 DeVito ..... A47F 5/0807 248/220.42
2012/0085720 A1 * 4/2012 Bettenhausen ..... A61L 2/26 211/85.13
2012/0217360 A1 * 8/2012 Fanning, Jr. ..... A47F 5/0823 248/220.31
2015/0129730 A1 * 5/2015 Gold ..... A47F 5/0823 248/220.42

* cited by examiner

*Primary Examiner* — Steven M Marsh
(74) *Attorney, Agent, or Firm* — Bay State IP, LLC

(57) ABSTRACT

This disclosure provides a hanging plate and hanging piece assembly comprising a hanging plate, a hanging piece and fixed pieces. A plurality of first through holes are formed in the hanging plate, a plurality of first through holes are uniformly formed in the transverse direction and the longitudinal direction respectively, a second through hole is formed in the central position of every four adjacent first through holes, a plurality of second through holes are formed in the longitudinal direction and the transverse direction respectively, and the second through holes are uniformly formed in the hanging plate; the hanging piece is arranged on the hanging plate, at least one first hook penetrating through the first through hole is arranged on the surface, in contact with the hanging plate, of a base plate of the hanging piece.

10 Claims, 4 Drawing Sheets

HANGING PANEL HANGER

CROSS REFERENCE TO RELATED APPLICATION

This application takes priority from and claims the benefit of Chinese Patent Application No. 201820807434.6 filed on May 29, 2018, the contents of which are herein incorporated by reference.

TECHNICAL FIELD

This disclosure relates to the technical field of article exhibition and display, in particular to a hanging plate and hanging piece assembly.

BACKGROUND

With the development of the society, more and more articles purchased by people are stacked together, and articles cannot be found quickly, in order to place the articles in order, the articles are usually hung by using a hanging plate and hanging piece assembly, the articles are placed in order and convenient for people to use, but hanging pieces are likely to fall off when the articles are taken and placed; or, various articles are stacked together and unlikely to find in a shop, some articles placed on the hanging pieces are convenient for people to take and place, when the articles are taken and placed, the hanging pieces frequently fall off from the hanging plate to cause scattering of the articles; or, in some exhibition halls, some articles are arranged on the hanging plate for people to appreciate and try out, and when the articles are taken and placed, the condition that the hanging pieces are separated from the hanging plate also may occur.

At present, the using effect of the hanging plate is relatively single, the hanging plates cannot be spliced infinitely according to practical situations, the hanging pieces simply hang on the hanging plate through respective hooks, the hanging pieces are easy to shake and are unstable so that the articles are easy to fall off and damage, or when a certain article is taken and placed by people, the hanging piece falls off from the hanging plate due to stress reduction, people need to spend time in putting the articles in order, time and energy are wasted, when the articles are placed or taken, the hanging pieces are easy to bump against the surface of the hanging plate so as to damage the hanging plate, and the articles placed on the hanging plate are low in stability.

Therefore, it is crucial that research a hanging plate and hanging piece assembly with simple installation and firm fixation, and moreover, the hanging plates can also be spliced infinitely.

SUMMARY

This disclosure aims to provide a hanging plate and hanging piece assembly, the hanging piece is firmly mounted on the hanging plate and is unlikely to fall off, and this disclosure provides the following technical scheme:

This disclosure provides a hanging plate and hanging piece assembly, comprising:

a hanging plate, a plurality of first through holes being formed in the hanging plate, a plurality of first through holes being uniformly formed in the transverse direction and the longitudinal direction respectively, a second through hole being formed in the central position of every four adjacent first through holes, a plurality of second through holes being formed in the longitudinal direction and the transverse direction respectively, and the second through holes being uniformly formed in the hanging plate;

a hanging piece arranged on the hanging plate, at least one first hook penetrating through the first through hole being arranged on the first surface of a base plate of the hanging piece, when there are a plurality of first hooks, the horizontal or vertical central distance between every two adjacent first hooks being an integer multiple of the horizontal central distance between every two adjacent first through holes, at least one third through hole running through the base plate being formed in the base plate, when there are a plurality of third through holes, the horizontal or vertical central distance between every two adjacent third through holes being an integer multiple of the horizontal central distance between every two adjacent second through holes, a bulge being arranged on the surface, in contact with the hanging plate, of the hanging piece, the bulge corresponding to the second through hole in the hanging plate, and a second hook for hanging an article is arranged on the second surface, opposite to the first surface, of the base plate;

and fixed pieces for fixedly mounting the hanging piece on the hanging plate, and the fixed pieces passing through the second through holes and the third through holes.

Preferably, each first through hole is of a symmetrical structure, each first through hole positioned at the position of the edge line of the hanging plate is a half hole, when every two hanging plates are combined and spliced, the two half holes at the positions of the edge lines of the hanging plates form a complete first through hole.

Preferably, the vertical distance between the bulge and the center of the third through hole is half of the vertical distance between the centers of every two adjacent second through holes in the longitudinal direction.

Preferably, the length of each fixed piece is greater than the sum of the length of each second through hole and the length of each third through hole.

Preferably, there are two first hooks, and the bulge and the first hooks are distributed triangularly.

Preferably, each second through hole is in the shape of a circle.

Preferably, each first through hole is in the shape of a square.

Preferably, each first hook is designed integrally with the base plate.

Preferably, the bulge is in the shape of a cylinder, and the axis of the cylinder is vertical to the first surface.

Preferably, each fixed piece is a screw.

This disclosure provides a hanging plate handing piece comprising a hanging plate, a hanging piece and fixed pieces. A plurality of first through holes are formed in the hanging plate, a plurality of first through holes are uniformly formed in the hanging plate in the transverse direction and the longitudinal direction respectively, a second through hole is formed in the central position of every four adjacent first through holes, a plurality of second through holes are formed in the longitudinal direction and the transverse direction respectively, and the second through holes are uniformly formed in the hanging plate; the hanging piece is arranged on the hanging plate, at least one first hook penetrating through the first through hole is arranged on the surface, in contact with the hanging plate, of a base plate of the hanging piece, at least one third through hole running through the base plate is formed in the base plate, a bulge is arranged on the surface, in contact with the hanging plate, of the hanging piece, the bulge corresponds to the first through hole in the hanging plate, and a second hook for hanging an object is arranged on the other surface of the base plate; the fixed pieces are fixedly mounted on the hanging plate, and the fixed pieces pass through the second through holes and the third through holes, so that the hanging piece is fixedly mounted on a hanging disc, the hanging piece is prevented from falling off when the object is taken and placed by people, and simultaneously, the hanging plate and hanging piece assembly is simple and convenient to mount.

BRIEF DESCRIPTION OF THE DRAWINGS

In order to illustrate the technical scheme in the embodiment of this disclosure or in the prior art more clearly, the accompanying diagrams needing to be used in the embodiment or in the description in the prior art are simply described. Apparently, the embodiments in the following description are merely a part rather than all of the embodiments of this disclosure. For ordinary technical staff in the art, under the premise of without contributing creative labor, other accompanying diagrams further can be obtained according to these accompanying diagrams.

In the figures, 1, hanging plate; 2, hanging piece; 11, first through hole; 12, second through hole; 21, first hook; 22, third through hole; 23, bulge; 24, second hook; and 3, fixed piece.

DESCRIPTION OF THE EMBODIMENTS

In order to make the purpose, technical scheme and advantages of this disclosure more clear, the technical scheme of this disclosure is described in detail as follows: Apparently, the embodiments in the following description are merely a part rather than all of the embodiments of this disclosure. Based on the embodiment in this disclosure, all other embodiments obtained by the ordinary technical staff in the art under the premise of without contributing creative labor belong to the scope protected by this disclosure.

The specific embodiment provides a display hanging plate and hanging piece assembly, the hanging piece is arranged on the hanging plate through the hooks, the bulge on the hanging piece is used for positioning, simultaneously the bulge can bear the weight, the hanging piece is firmly fixed on the hanging plate through the fixed pieces, and the situations that the hanging piece falls off and the article is broken when the article is taken and placed are avoided.

The embodiment is described referring to the accompanying diagrams as follows. Moreover, the embodiment illustrated in the following does not play any limitation role on the content of this disclosure recorded by the claims. In addition, all content illustrated in the following embodiment is not limited to the necessary for the solution recorded by the claims.

Referring to FIG. 1 to FIG. 5, the hanging plate and hanging piece assembly provided by this disclosure comprises a hanging plate 1, a hanging piece 2 and fixed pieces 3, the hanging piece 2 is arranged on the hanging plate 1, the fixed pieces 3 are used for fixedly connecting the hanging piece 2 and the hanging plate 1, so that the hanging piece 2 is fixed on the hanging plate 1, and the hanging piece is unlikely to fall off when the object is taken and placed.

Figure 3:
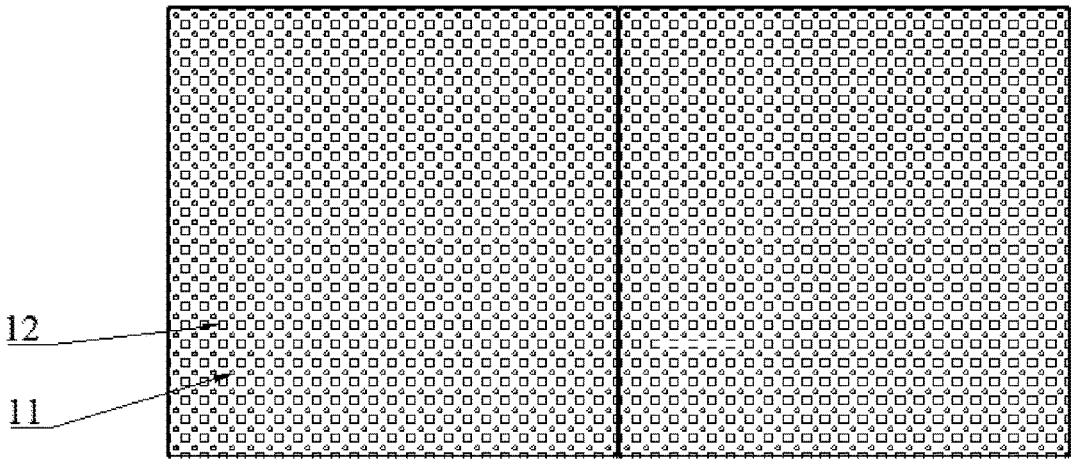
FIG. 3 is a structure schematic diagram of a hanging plate illustrated according to an exemplary embodiment.
Figure 4:
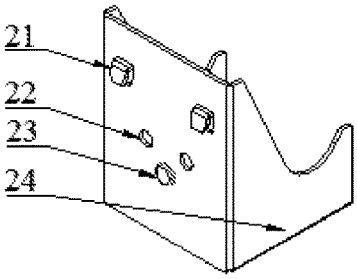
FIG. 4 is a structure schematic diagram of a hanging piece illustrated according to an exemplary embodiment.
Figure 5:
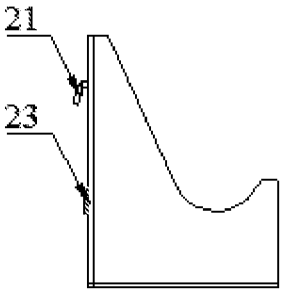
FIG. 5 is a left view of a hanging piece structure illustrated according to an exemplary embodiment.

A plurality of first through holes 11 are formed in the hanging plate 1, the first through holes 11 are uniformly distributed along the transverse direction and the horizontal direction respectively, a second through holes 12 are formed in the central positions of every four adjacent first through holes 11, the shapes and sizes of the first through holes 11 can be the same as or also can be different from those of the second through holes 12, a plurality of second through holes 12 are formed in the longitudinal direction and the transverse direction respectively, as shown in FIG. 3, the first through holes 11 are uniformly formed in the hanging plate 1 from left to right and from up to down, the distance between the centers of every two adjacent first through holes 11 transversely or longitudinally is a constant value which is set to be a, the distance between the centers of every two adjacent second through holes 12 transversely or longitudinally is also a, and the positions of the centers of every four adjacent first through holes 11 are the positions of the centers of a square formed by every four adjacent first through holes 11 transversely and longitudinally.

Wherein, the hanging piece 2 is arranged on the hanging plate 1, the first surface of a base plate of the hanging piece 2 is in contact with the hanging plate 1, a second hook 24 is arranged on the second surface opposite to the first surface of the base plate, the second hook 24 is used for hanging an object, at least one first hook 21 is arranged on the first surface of the base plate in contact with the hanging plate 1, the first hook 21 is arranged inside the first through hole 11 in the hanging plate 1, when there are a plurality of first hooks 21, the horizontal or vertical central distance between every two adjacent first hooks 21 is an integer multiple of the horizontal central distance between every two adjacent first through holes 11, namely an integer multiple of the constant value a, a bulge 23 is further arranged on the base plate, the bulge 23 corresponds to the first through hole 11 in the hanging plate 1, and the first hook 24 hangs inside the first through hole 11, the bulge 23 is simultaneously also arranged inside the first through hole 11 to provide a supporting point, at least one third through hole 22 passing through the base plate is further formed in the base plate as well, and when there are a plurality of third through holes 22, the horizontal or vertical distance between every two adjacent third through holes 22 is an integer multiple of the constant value a as well.

Figure 1:
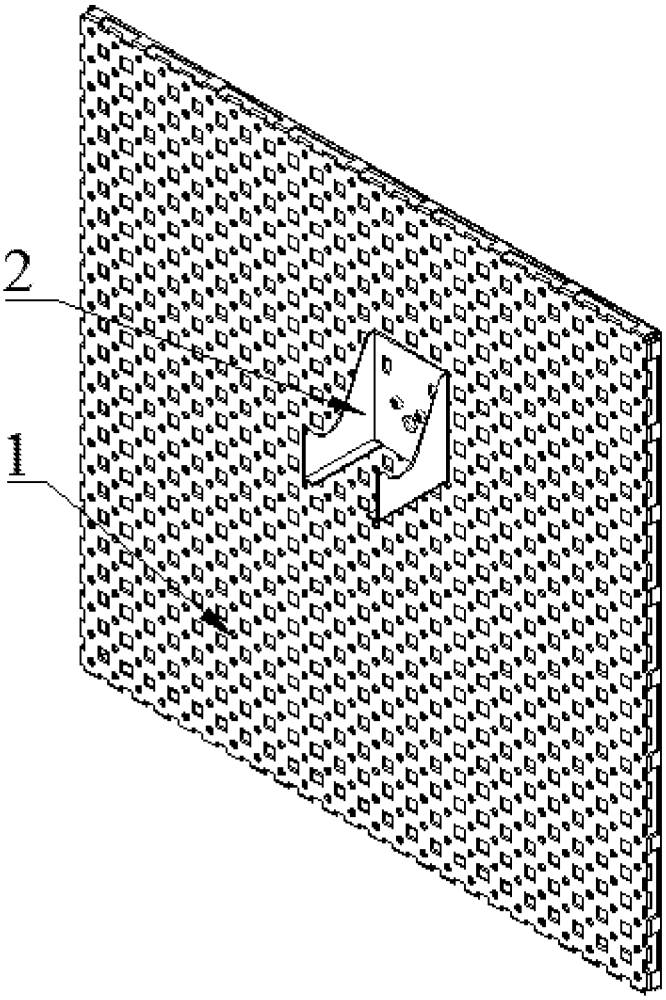
FIG. 1 is a schematic diagram of a hanging plate and hanging piece assembly illustrated according to an exemplary embodiment.
Figure 2:
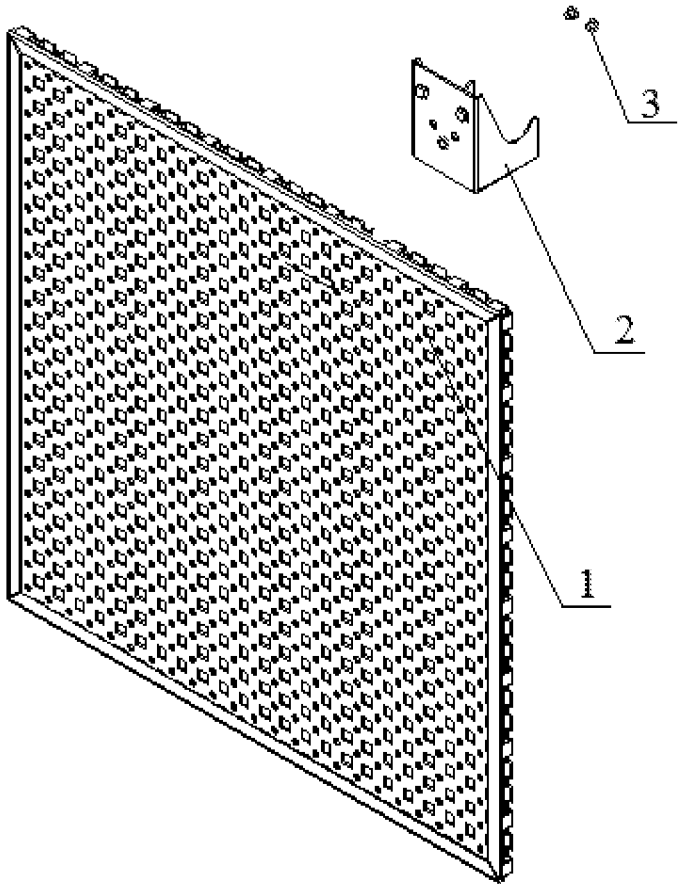
FIG. 2 is a decomposition schematic diagram of the hanging plate and hanging piece assembly illustrated according to an exemplary embodiment.

It should be noted that the words such as "first", "second" and "third" expressed in this disclosure are not the restriction of a specific sequence, but are just used for distinguishing the components or functions. The words such as "up", "down", "left", "right", "transverse" and "longitudinal" indicate the direction of the hanging plate and hanging piece in a placing state as shown in FIG. 2.

Wherein, the fixed pieces 3 pass through the third through holes 22 in the hanging piece 2, and the second through holes 12 in the hanging plate 1 are used for fixing the hanging piece onto the hanging plate 1, so that the hanging piece 2 is fixedly arranged on the hanging plate 1, the hanging piece 2 is unlikely to fall off from the hanging plate 1, when the object is taken and placed, the hanging piece 2 is unlikely to get loosen, and the hanging object is stable and safe.

Through the preferred scheme in the embodiment, the shape of the first through hole 11 is symmetrical, the first through hole 11 at the position of the edge line of the hanging plate 1 is a half hole, namely, the edge line of the hanging plate 1 passes through the center of the first through hole 11. In this way, when a plurality of hanging plates 1 are combined and spliced, two half holes at the positions of the edge lines of every two adjacent hanging plates 1 form a complete first through hole 11, the hanging plates 1 spliced together looks like an integral plate, the condition that the first hook 21 of the hanging piece 2 is not matched with the distance between the first through holes 11 in the hanging plate 1 so as not to be used cannot be caused at the positions of joints, and the hanging plate 1 can extend infinitely according to practical situations.

Through the preferred scheme in the embodiment, the vertical distance between the central point of the bulge 23 and the center of the third through hole 22 is half of the vertical distance between the central points of every two longitudinally adjacent first through holes 11, namely the vertical distance between the central point of the bulge 23 and the center of the third through hole 22 is half of a.

In the embodiment, the length of each fixed piece 3 is greater than the sum of the length of the second through hole and the length of the third through hole, so that the fixed pieces 3 can be used for firmly arranging the hanging piece on the hanging plate.

Through the preferred scheme of the embodiment, when there are two first hooks 21, the bulge 23 and the first hooks 21 are distributed triangularly, according to the principle that a plane is formed by three points, the stability of the hanging piece 2 is guaranteed, and the condition that the hanging piece 2 waggles left and right is prevented.

Wherein, the second through hole 12 is in the shape of a circle, and due to the fact that most of the fixed pieces 3 are circular, the fixed pieces 3 are convenient to pass through the second through hole 12 and are convenient to install.

Wherein, the shape of the first through hole 1 is in the shape of a square, the load bearing strength of the square hook hole is large, when the first through hole 11 is a circular hole, the position, in contact with the first through hole 11, of the first hook 21 is in point-to-point contact, the stress position is relatively small, the first through hole 11 is easy to deform, when the first through hole 11 is in the shape of a triangle, the first hook 21 is in line-to-line contact with the first through hole 11, but the transverse width of the triangle changes, the first hook 21 is unlikely to install, the first hook 21 is arranged to be square or rectangular, namely the first hook 21 is easy to install and large in load bearing capacity, and simultaneously, the hanging piece 2 can be placed no matter the hanging plate is placed transversely or vertically.

Through the preferred scheme in the embodiment, the first hook 21 and the base plate are integral, so that the stability of the first hook 21 is guaranteed, the condition that the first hook 21 is broken is avoided, simultaneously, the second hook 24 also can be designed integrally with the base plate, the stability of the second hook 24 is guaranteed, the shape of the second hook 24 can change according to practical situations, but is not restricted specifically herein.

Wherein, the bulge 23 is in the shape of a cylinder, the axis of the cylinder is vertical to the first surface, the sectional area of the cylinder is smaller than that of the first through hole 11, and the bulge 23 is convent to insert in the first through hole 11.

Through the preferred scheme in the embodiment, the fixed pieces 3 can be screws, rivets or buckles as long as the hanging piece 2 is fixed, the screws can be reused, and when the position of the hanging piece 2 needs to change, the screws are unscrewed from the hanging plate 1, so that the time and labor are saved; the rivets and the buckles are convenient to install, a hanging rack fixedly installed through the screws is firmly arranged on the hanging plate 1, and the hooks are avoided from being stressed to waggle when the object is taken and placed.

The following is combined with the content of the above embodiment and the preferred scheme thereof, the hanging plate and hanging piece assembly is specifically described, as shown in FIG. 1 to FIG. 5.

The embodiment provides a hanging plate and hanging piece assembly comprising a hanging plate 1, a hanging piece 2 and fixed pieces 3.

The central distance between the first through holes 11 in the horizontal direction or the vertical direction in the hanging plate 1 is a constant value a, and the shape of the first through hole 11 is a square; the central distance between the second through holes 12 in the horizontal direction or the vertical direction in the hanging plate 1 is a constant value b as well, the constant value b is equal to the constant value a, and the shape of the second through hole 12 is a circle; a circular through hole is formed in the position of the center of the square formed by every four adjacent square through holes.

The square through hole positioned in the position of the edge line of the hanging plate 1 is a half hole;

The central distance between the first hooks 21 on the hanging piece is an integer multiple of the constant value a;

The distance between the third through holes 22 in the hanging piece is the constant value a;

The vertical distance between the center of the third through hole 22 and the center of the bulge 23 on the hanging piece is half of the constant value a;

Thus, the hanging piece 2 is mounted on the hanging plate 1 so that the first hook 21 can just hang on the square through hole in the hanging plate, the bulge 23 is just mounted on the square through hole, the third through hole 22 in the hanging piece 2 just aligns to the circular through hole in the hanging plate, the fixed pieces 3 are used for mounting the fixed hanging piece 2 onto the hanging plate 1, the hanging rack is avoided from falling off when the object is taken and placed, simultaneously, the hanging plates 1 can be infinitely spliced according to practical situations, when the hanging plates 1 are spliced and combined, the two half holes positioned at the edge positions of the hanging plate 1 can be spliced to form a complete square through hole, and the central distance of the square through hole remains unchanged as the constant value.

The foregoing descriptions are merely specific embodiments of this disclosure, but are not intended to limit the protection scope of this disclosure. Any variation or replacement readily figured out by a person skilled in the art within the technical scope disclosed in this disclosure shall fall within the protection scope of this disclosure. Therefore, the protection scope of this disclosure shall be subject to the protection scope of the claims.

What is claimed is:

1. A hanging plate and hanging piece assembly, characterized by comprising:

a hanging plate (1), a plurality of first through holes (11) being formed in the hanging plate (1), a plurality of first through holes (11) being uniformly formed in the transverse direction and the longitudinal direction respectively, a second through hole (12) being formed in the central position of every four adjacent first through holes (11), a plurality of second through holes (12) being formed in the longitudinal direction and the transverse direction respectively, and the second through holes (12) being uniformly formed in the hanging plate (1);

a hanging piece (2) arranged on the hanging plate (1), at least one first hook (21) penetrating through the first through hole (11) being arranged on the first surface of a base plate of the hanging piece (1), when there are a plurality of first hooks (21), a horizontal or vertical central distance between every two adjacent first hooks (21) being an integer multiple of the horizontal central distance between every two adjacent first through holes (11), at least one third through hole (22) running through the base plate being formed in the base plate, when there are a plurality of third through holes (22), a horizontal or vertical central distance between every two adjacent third through holes (22) being an integer multiple of a horizontal central distance between every two adjacent second through holes (12), a bulge (23) being arranged on the surface, in contact with the hanging plate (1), of the hanging piece (2), the bulge (23) corresponding to the second through hole (12) in the hanging plate (1), and a second hook (24) for hanging an article is arranged on the second surface, opposite to the first surface, of the base plate;

and fixed pieces (3) for fixedly mounting the hanging piece (2) on the hanging plate (1), and the fixed pieces (3) passing through the second through holes (12) and the third through holes (22).

2. The hanging plate and hanging piece assembly according to claim 1, characterized in that each first through hole (11) is of a symmetrical structure, each first through hole (11) positioned at the position of the edge line of the hanging plate (1) is a half hole, when every two hanging plates (1) are combined and spliced, the two half holes at the positions of the edge lines of the hanging plates (1) form a complete first through hole (11).

3. The hanging plate and hanging piece assembly according to claim 1, characterized in that a vertical distance between the bulge (23) and the center of the third through hole (22) is half of a vertical distance between the centers of every two adjacent second through holes (12) in the longitudinal direction.

4. The hanging plate and hanging piece assembly according to claim 1, characterized in that a length of each fixed piece is greater than a sum of the length of each second through hole (12) and the length of each third through hole (22).

5. The hanging plate and hanging piece assembly according to claim 1, characterized in that there are two first hooks (21), and the bulge (23) and the first hooks (21) are distributed triangularly.

6. The hanging plate and hanging piece assembly according to claim 1, characterized in that each second through hole (12) is in the shape of a circle.

7. The hanging plate and hanging piece assembly according to claim 1, characterized in that each first through hole (11) is in the shape of a square.

8. The hanging plate and hanging piece assembly according to claim 1, characterized in that each first hook (21) is designed integrally with the base plate.

9. The hanging plate and hanging piece assembly according to claim 1, characterized in that the bulge (23) is in the shape of a cylinder, and the axis of the cylinder is vertical to the first surface.

10. The hanging plate and hanging piece assembly according to claim 1, characterized in that each fixed piece (3) is a screw.

* * * * *